United States Patent [19]

Hauck et al.

[11] 4,347,091

[45] Aug. 31, 1982

[54] APPARATUS FOR THE PRODUCTION OF JACKETS FOR RECORDING DISKS

[75] Inventors: Karl Hauck, Maxdorf; Hubert Fehrenbach, Kehl; Dieter Mayer; Herbert Wagner, both of Ludwigshafen; Kurt Zwintzscher, Willstaett, all of Fed. Rep. of Germany

[73] Assignee: BASF Aktiengesellschaft, Ludwigshafen, Fed. Rep. of Germany

[21] Appl. No.: 254,259

[22] Filed: Apr. 15, 1981

[30] Foreign Application Priority Data

May 12, 1980 [DE] Fed. Rep. of Germany ... 8012859[U]

[51] Int. Cl.[3] ..... B09D 23/10

[52] U.S. Cl. ..... 156/217; 156/227; 156/443; 156/492

[58] Field of Search ..... 156/227, 475, 443, 216, 156/217, 492

[56] References Cited

U.S. PATENT DOCUMENTS

| | | | |
|---|---|---|---|
| 2,837,979 | 6/1958 | Vilutis | 156/492 X |
| 3,043,737 | 7/1962 | Engelstein | 156/216 X |
| 3,580,770 | 5/1971 | Dyal | 156/216 |
| 3,861,124 | 1/1975 | Bentyien | 156/443 X |
| 3,929,547 | 12/1975 | Paccagnella | 156/443 |
| 4,272,235 | 9/1981 | Barnett | 156/443 X |
| 4,310,371 | 1/1982 | Appoldt | 156/227 |

*Primary Examiner*—David A. Simmons

*Attorney, Agent, or Firm*—Keil & Witherspoon

[57] ABSTRACT

An apparatus for the production of a jacket for a recording disk from a foldable blank, comprising a stationary receiving surface for one half of the blank and a further surface, pivotable essentially through an angle of 180°, for bending over the other half of the blank; a sheet-like spacer member which can be positioned over the stationary receiving surface, and one of whose edges, serving as a folding blade, is allocated to the swing point of the two said surfaces; and means for heating the fold area of the blank.

7 Claims, 2 Drawing Figures

APPARATUS FOR THE PRODUCTION OF JACKETS FOR RECORDING DISKS

Figure 1:
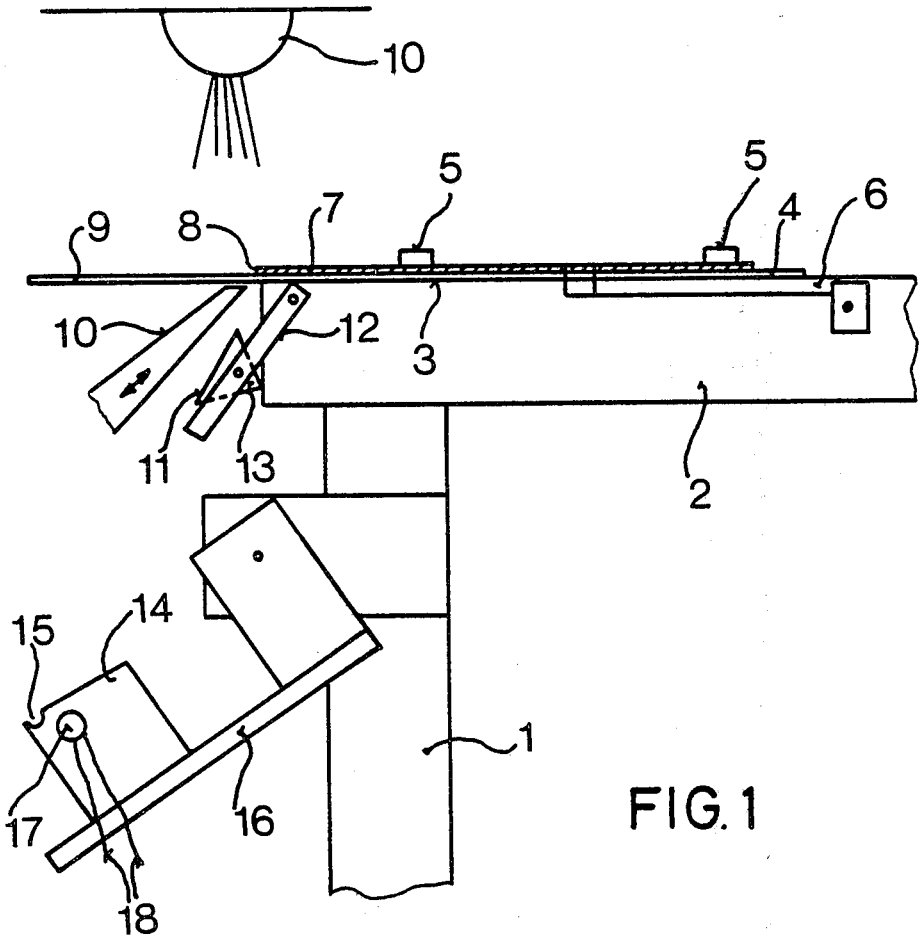

The present invention relates to an apparatus for the production of a jacket for a recording disk from a foldable blank, comprising a stationary surface, provided with positioning elements for receiving one half of the blank, and at least one sheet-like spacer member which can be positioned over said stationary receiving surface and to the edge of which, serving as a folding blade and running the length of the fold to be made, there are allocated a further surface, pivotable essentially through an angle of 180°, for bending over the other half of the blank to form the jacket, and means for heating the fold area of the blank.

It is known for example from U.S. patent application Ser. No. 66,553 that a jacket for a flexible data recording disk can be manufactured from a PVC blank, provided on one side with a covering of nonwoven material, by folding the blank on a mechanized assembly system, by controlled pivoting and up and down movements of various folding means, to form the jacket, the folds being stabilized by heating and subsequently cooling the material in the region of the folds, and the surfaces which come into contact on folding being joined to one another in the marginal portions of the jacket.

It has been found that the lateral surfaces of jackets manufactured in this way bow outwardly as a result of the still present restoring force of the material at the folds, so that the jackets assume a convex shape. This deformation, which may be large or small depending on the composition of the material from which the blank is made, has an adverse effect on the write and read operations.

Accordingly, it is an object of the present invention to provide an apparatus for the production of a jacket for a recording disk from a foldable blank, with which the said disadvantages are avoided.

We have found that this object is achieved with an apparatus of the initially described type, wherein there is provided a bar which can be moved toward and away from, and runs parallel to, the folding blade of the spacer member, and can encompass the fold in the blank, and which is provided with one or more heat-producing means that can be connected up to a source of energy for at least part of the time.

In a preferred embodiment of the novel apparatus the heater bar has a groove whose cross-sectional shape matches that of the fold in the blank, and which runs parallel to the folding blade.

The heater bar can for example be heated with the aid of an electrical resistance or inductively or by means of a heating medium flowing through a cavity in the bar. It is also possible to heat the fold in the blank dielectrically with the aid of an electrode fitted in the bar and connected up to a high-frequency generator.

In a further advantageous embodiment, the heater bar is pivotally mounted.

In yet another advantageous embodiment, the heater bar can be moved toward and away from the folding blade by means of a drive member.

With the apparatus according to the invention it is possible, at low cost, to precisely and uniformly shape the fold in the blank after the folding operation and to stabilize the resulting fold, the two halves of the blank forming the jacket being completely flat and running parallel to one another.

Figure 2:
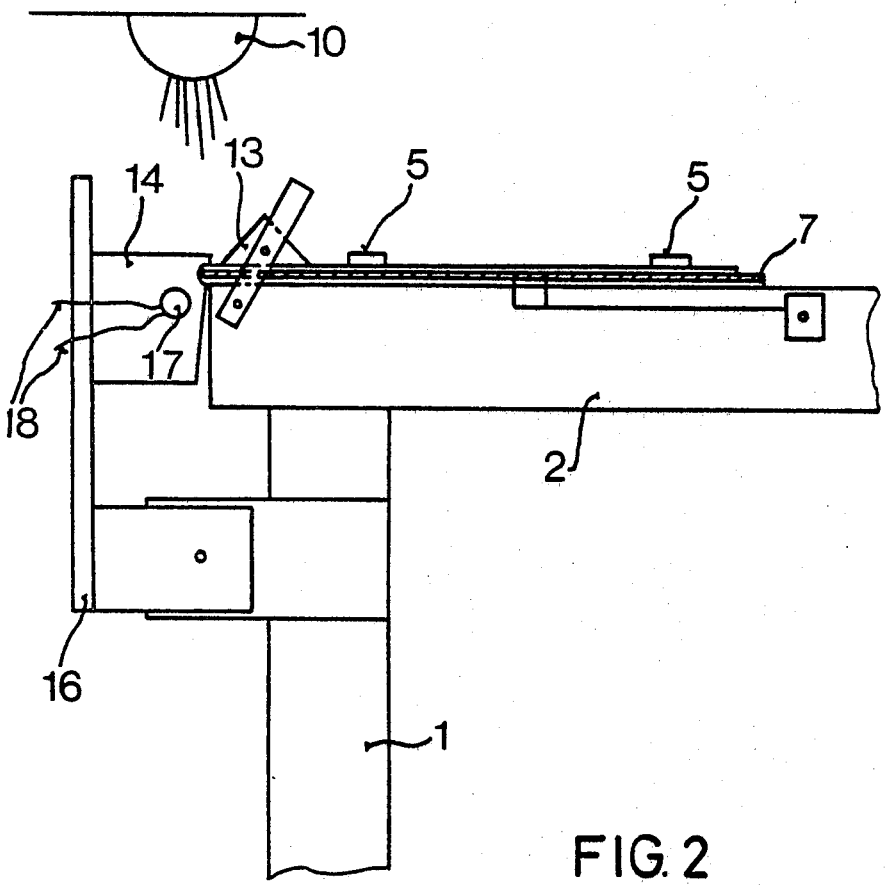

Further advantages and details of the apparatus according to the present invention are described below with reference to the embodiment illustrated in the accompanying drawings, in which FIG. 1 is a schematic side view of the novel apparatus, with a blank positioned thereon prior to the folding, and FIG. 2 is a schematic side view of the apparatus of FIG. 1 after the folding operation.

Referring to FIG. 1, a plate 2 serving as receiving surface 3 for the blank 4 to be folded is mounted on a frame 1. For exactly positioning the blank, positioning members 5 which cooperate with the functional apertures punched in the blank, usually a central hole of larger diameter than the hole in the disk, and a radial elongate slot, are screwed into the said plate.

The free ends of a pair of arms 6 pivotally mounted on frame 1 or plate 2 have attached thereto a sheet-like spacer member 7 which, after the blank 4 to be processed has been placed in position, is swung down onto it, and whose front edge acts as a folding blade 8. This folding blade is somewhat longer than the width of the blank, so that the projecting half of the blank can be readily folded about it. The thickness of the spacer member corresponds to the desired distance between the two halves forming the jacket.

A source of heat 10, preferably an infrared lamp, for preheating the area of the blank where the fold is to be made is arranged parallel to the folding blade 8, the heating temperature and time being able to be set in advance in the conventional manner. A contact heater, e.g. a heatable bar which can be advanced against the blank from below and then retracted, can of course be used instead of the infrared lamp. This preheating increases the deformability and hence the foldability of the material from which the blank is made, usually sheet material of PVC, polyvinyl acetate, polystyrene, polyethylene, polypropylene or a mixture thereof. The projecting half 9 of the blank is bent around folding blade 8 of spacer member 7 by a surface 11 on a bar 13 mounted on frame 1, via a pair of arms 12, for pivotal movement through an angle of 180°, and running parallel to the folding blade.

According to the invention the fold is then after-treated, i.e. the deformation in the material of the blank produced by folding is fixed by a heating step which immediately follows the folding operation. A bar 14 which corresponds in length to folding blade 8 and runs parallel thereto, and which has a groove 15 matching the cross-sectional shape of the fold in the blank and also running parallel to the folding blade is used for this purpose. Bar 14 which is pivotally mounted on the frame via a pair of arms 16 is swung up against the folded edge after folding, as shown in FIG. 2, so that the groove snugly embraces said folded edge. In practise, the groove will have short parallel side walls and a semicircular bottom, the diameter of the semicircle corresponding to the thickness of the jacket. To facilitate entry of the folded edge into the groove, the edges of the latter are slightly rounded. In this state of operation of the apparatus, the fold is heated by a resistance heater which is fitted in the bar and can be connected to a source of energy by wires 18, the heating temperature and time being adjustable by conventional means. Suitable timers and thermostats are commercially available. After groove 15 has acted for a predetermined period, bars 14 and 13 are swung back into their initial positions, so that the folded blank can be removed and reinserted to effect folding of the other edges after the positioning element for the elongate slot has been suitably relocated.

As a result of the thermal aftertreatment of the folds, the edges of the finished jacket are precisely shaped and stabilized.

Other heat sources can of course be used in bar 14 for heating the material of the blank, e.g. an energy converter operating on the induction principle or an electrode fitted in the bar and connected to a high-frequency generator for the dielectric heating of the material. The bar can also be of hollow construction, so that for example steam from a heat source can flow therethrough.

The apparatus according to the present invention is not restricted to the above-described embodiment, but its construction can be varied using the means with which the skilled artisan is familiar. For example, the pivotal mounting of the parts can be replaced by a sliding one or by raising/lowering and advancing/retracting means.

For mechanized operation of the apparatus, the pairs of arms 6, 12 and 16 are connected to pneumatically or hydraulically operated piston/cylinder units (not shown in the drawing for the sake of simplification). The blank is advantageously inserted and removed by vacuum-operated gripping means which can be raised, lowered and pivoted. Conventional control means can be used for the automatic operation of the drive and gripping means.

The invention is further illustrated by the following Example.

EXAMPLE

A blank punched out of 250 μm thick sheeting produced from a mixture of PVC and polyvinyl acetate, and having a covering of nonwoven material on one side is preheated by means of a radiant heater prior to folding. The power input is so adjusted that a temperature of about 60° C. prevails for one second in the area where the fold is to be made. After folding, the folded edge of the blank is shaped for two seconds by the groove in the heater bar at a temperature of 150° C.

We claim:

1. In an apparatus for the production of a jacket for a recording disk from a foldable blanket of plastic material, comprising a stationary surface provided with positioning elements for receiving one-half of the blank, at least one sheet-like spacer member extending the length of the fold to be made and having an edge serving as a folding blade, means for positioning said spacer member on said stationary surface, means having a surface for bending the other half of the blade, through an angle of 180°, over said spacer member and said one-half of the blank, and means for heating the fold area of the blade incident to said folding, the improvement that, for minimizing the outward buckling of the jacket as a result of the residual restoring force of the plastic material at the fold, there are provided after treatment means including:

a bar extending parallel to the folding blade of the spacer member and having a groove whose cross-sectional shape corresponds to that of the external diameter of the completed jacket, heat-producing means in said bar which are connectable to a source of energy, and means for moving said bar towards and away from the folding blade.

2. The improvement as claimed in claim 1, wherein said heat producing means are of the electrical resistance type.

3. The improvement as claimed in claim 1, wherein said heat producing means are of the inductive type.

4. The improvement as claimed in claim 1, wherein the heat producing means are provided with an electrode connected to a high frequency generator, for the dielectric heating of the fold in the blank.

5. The improvement as claimed in claim 1, wherein the heater bar has a cavity for the passage of a heating medium therethrough.

6. The improvement as claimed in claim 1, wherein the heater bar is pivotally mounted.

7. In a process for manufacturing a jacket for a recording disk from a foldable blank of plastic material, in which the blank, having two half-sections, is placed on a support surface, a sheet-like spacer member having a front edge serving as a folding blade is placed on top of one of the half-sections of the blank, the projecting other half-section is folded, upon the application of heat, over said folding blade and the first-mentioned half-section and the marginal portions of the two half-sections are then joined together, a method for minimizing the outward deformation of the jacket as a result of the residual restoring force of the plastic material at the fold, said method comprising the after treatment of uring, subsequent to the folding of said one half-section over the other half-section and with the spacer member still in place, a pressure element extending parallel to the fold against the outside of said fold under the application of heat, said pressure element having lengthwise thereof a substantially semi-cylindrical groove with a diameter corresponding to the external dimension of the completed jacket.

* * * * *